United States Patent [19]

Kawamura et al.

[11] Patent Number: 4,491,626

[45] **Date of Patent: * Jan. 1, 1985**

[54] PHOTOSENSITIVE MEMBER

[75] Inventors: Takao Kawamura, Sakai; Masazumi Yoshida, Amagasaki, both of Japan

[73] Assignees: Minolta Camera Kabushiki Kaisha; Takao Kawamura, both of Osaku; Kyocera Corp., Kyoto, all of Japan

[ * ] Notice: The portion of the term of this patent subsequent to May 29, 2001 has been disclaimed.

[21] Appl. No.: 473,005

[22] Filed: Mar. 7, 1983

[30] Foreign Application Priority Data

Mar. 31, 1982 [JP] Japan ..... 57-54565
Mar. 31, 1982 [JP] Japan ..... 57-54566

[51] Int. Cl.[3] ..... G03G 5/08; G03G 5/14; G03G 5/024

[52] U.S. Cl. ..... 430/69; 252/501.1; 357/2; 430/57; 430/60; 430/95

[58] Field of Search ..... 430/57, 95, 60, 69; 427/79; 357/2; 252/501.1

[56] References Cited

U.S. PATENT DOCUMENTS 3,647,427 3/1972 Hanada et al. ..... 430/57
3,696,262 10/1972 Antypas ..... 252/501.1
3,719,486 3/1975 Goldman et al. ..... 252/501.1
4,147,667 4/1979 Chevallier et al. ..... 252/501.1
4,451,546 5/1984 Kawamura et al. ..... 430/60 X

FOREIGN PATENT DOCUMENTS 55-62781 5/1980 Japan .
56-11603 9/1981 Japan .
56-150753 11/1981 Japan .

*Primary Examiner*—John E. Kittle
*Assistant Examiner*—Mukund J. Shah
*Attorney, Agent, or Firm*—Watson, Cole, Grindle & Watson

[57] ABSTRACT

The invention disclosed relates to a photosensitive member having excellent photosensitivity characteristics in the visible light region as well as in the near infrared region. According to first embodiment of the invention, the photosensitive member comprises an electrically conductive substrate, an amorphous silicon-germanium photoconductive layer having a thickness of about 0.1 to 3 microns, and an amorphous silicon photoconductive layer of 5 to 30 micron thick formed on the amorphous silicon-germanium photoconductive layer. Second embodiment of the photosensitive member comprises a substrate, an amorphous silicon semiconductor layer of 5 to 100 micron thick and an amorphous silicon-germanium photoconductive layer formed on the amorphous silicon semiconductor layer.

7 Claims, 7 Drawing Figures

PHOTOSENSITIVE MEMBER

BACKGROUND OF THE INVENTION

1. Field of the Invention

This invention relates to a photosensitive member having excellent photosensitivity characteristics in the visible light region as well as in the near infrared region.

2. Description of the Prior Art

In recent years, the application of amorphous silicon (hereinafter referred to briefly as a-Si), amorphous germanium (hereinafter, a-Ge) and amorphous silicon-germanium (hereinafter, a-Si:Ge) to electrophotographic photosensitive members glow discharge decomposition or sputtering techniques has been gathering attention. This is because photosensitive members containing a-Si, a-Ge and a-Si:Ge are by far superior to the conventional selenium or CdS photosensitive members in terms of freedom from environmental pollution, heat resistance and wear resistance, among others.

Especially in the case of a-Si:Ge, the band gap of Ge is smaller than that of a-Si, so that the addition of an adequate amount of Ge to a-Si can be expected to have the effect of extending the photosensitive range to a longer wavelength, and such extension, if attained, would enable the application of a-Si:Ge to semiconductor laser beam printers now under rapid development. In this connection, when an a-Si:Ge photoconductive layer is used in the form of a single layer structure as above, an increase in the Ge content relative to a-Si will extend the photosensitivity range to a longer wavelength but unfavorably decrease the overall (inclusive of the visible light region) photosensitivity. In other words, Ge is effective in increasing the sensitivity on the longer wavelength side but at the same time it impairs, in a contradictory manner, the excellent visible light region photosensitivity originally owned by a-Si. Therefore, the content of Ge is fairly restricted, and accordingly photosensitive members having desirable photosensitivity characteristics cannot be obtained. Furthermore, Ge is not only high in light absorptivity as compared with a-Si but also low in mobility of charge carriers generated by light absorption. This means that, in the case of a single layer structure, many of the charge carriers are trapped within the photoconductive layer, whereby the residual potential is increased and the photosensitivity decreased in a disadvantageous manner.

SUMMARY OF THE INVENTION

It is accordingly a primary object of the present invention to provide a photosensitive member having high photosensitivity, at least in the near infrared region.

It is another object of the present invention to provide a photosensitive member having excellent photosensitivity characteristics, both in the visible light region and the near infrared region.

It is still another object of the present invention to provide a photosensitive member capable of producing good images and suitable for use in a laser beam printer.

These and other objects of the present invention can be achieved by providing a photosensitive member which comprises an electrically-conductive substrate, a relatively thick amorphous silicon layer acting at least as a charge-retaining layer, and a relatively thin amorphous silicon-germanium photoconductive layer which ensures high photosensitivity in the near infrared region.

DETAILED DESCRIPTION OF THE INVENTION

Figure 1:
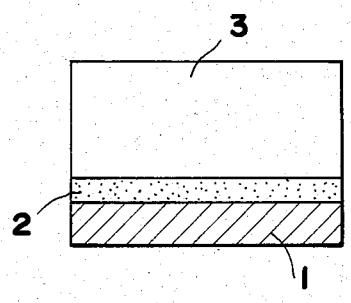
FIG. 1 illustrates the laminated construction of the photosensitive member according to a first embodiment of the present invention.

FIG. 1 illustrates a first embodiment of the photosensitive member in accordance with the present invention wherein 1 is an electrically-conductive substrate and 2 and 3 are, respectively, an a-Si:Ge photoconductive layer and an amorphous silicon photoconductive layer.

The a-Si:Ge photoconductive layer 2 to be formed on the substrate 1 is formed to a thickness of about 0.1 to 3 microns by glow discharge decomposition or sputtering, for instance, and contains at least about 10 to 40 atomic % of hydrogen. This is because $SiH_4$ and $GeH_4$ or the like are used as the starting materials in the glow discharge decomposition method and that it is convenient to use hydrogen as the carrier gas for $SiH_4$ and $GeH_4$. The dark resistance of the a-Si:Ge photoconductive layer 2 thus containing hydrogen alone is less than $10^{10}\Omega$ cm but does not cause any inconvenience since the a-Si photoconductive layer 3 hereinafter described functions as a charge-retaining layer. If necessary, however, an adequate amount of an impurity of Group IIIA of the Periodic Table, preferably boron, and further a trace amount of oxygen may be incorporated so as to increase the dark resistance or sensitivity. It is preferable that the Group IIIA impurity content is about 10 to 20000 ppm and the oxygen content of $10^{-3}$ to $5\times10^{2}$ atomic percent. Oxygen markedly increases the dark resistance but conversely decreases the photosensitivity. When the oxygen content exceeds $5\times10^{-2}$ atomic percent, the photosensitivity characteristics inherent to a-Si:Ge are impaired. A Group IIIA impurity alone can increase the dark resistance to a certain extent and gives the highest degree of sensitivity.

Since the band gap of Ge is narrow as compared with a-Si, the above a-Si:Ge photoconductive layer 2 ensures excellent photosensitivity in the near infrared region, especially in the longer wavelength region of 700–900 nm. Thus, Ge improves the photosensitivity in the longer wavelength region, which is low with a-Si alone, and enables the application of the photosensitive member in semiconductor laser beam printers which use an exposure light source emitting light of a wavelength of about 800 nm. For the purpose of increasing the longer wavelength region sensitivity, Ge can be contained in a a-Si:Ge molar ratio of maximum 1:1 to minimum 19:1. Thus, if the photoconductive layer is expressed as a-$Si_x Ge_{1-x}$, then x is 0.5–0.95. The molar ratio should be at least 19:1 because lower Ge contents cannot be expected to increase the longer wavelength region sensitivity. If the Ge content is more than 1:1, the sensitivity will rather be decreased. This is presumably because, since the band gap of Ge is considerably narrow as compared with a-Si, incorporation of a large amount of Ge leads to trapping of charge carriers generated in the a-Si:Ge photoconductive layer 2 in the interface with the a-Si photoconductive layer 3.

The thickness of the a-Si:Ge photoconductive layer 2 should be at least 0.1 micron, since at smaller thicknesses light absorption is insufficient and the sensitivity cannot be ensured. The upper limit of about 3 microns is placed on the layer thickness on the grounds that the charge-retaining of the photosensitive member is ensured by the a-Si photoconductive layer and further that, as mentioned hereinbefore, the band gap of Ge is narrow and the charge carrier mobility is small.

The a-Si photoconductive layer 3 is formed likewise on the a-Si:Ge photoconductive layer 2 to a thickness of about 5 to 30 microns, preferably 10 to 20 microns, by glow discharge decomposition or sputtering. This a-Si photoconductive layer 3 is preferably used as an image-forming layer, i.e., an image is to be formed on its surface in view of its excellences in freedom from environmental pollution, heat resistance and wear resistance. In addition, the layer 3 is to function as a photoconductive layer which ensures the photosensitivity in the visible light region as well as to function as a charge-retaining layer. In order to hold both of these functions, the a-Si photoconductive layer 3 of the above thickness contains therein about 10 to 40 atomic % of hydrogen, about $10^{-5}$ to $5\times10^{-2}$ atomic % of oxygen and about 10 to 20000 ppm of a Group IIIA impurity (preferably boron) of the Periodic Table. Inclusion of these amount of hydrogen, oxygen and a Group IIIA impurity are disclosed in the applicants' copending U.S. patent application Ser. No. 254,189, filed on Apr. 14, 1981, the content of which is incorporated herein by reference. As disclosed therein, the dark resistance of the a-Si photoconductive layer is less than $10^{10}\Omega\cdot$ cm with hydrogen alone and accordingly, it cannot be used as the charge-retaining layer which requires the dark resistance of $10^{13}\Omega\cdot$cm or more. However, the inclusion of the above amount of oxygen and the impurity in addition to hydrogen ensures the dark resistance of greater than $10^{13}\Omega\cdot$ cm, thereby enabling the layer to function as the charge-retaining layer. The amount of oxygen should be less than 0.05 atomic % in order to ensure fine photosensitivity but more than $10^{-5}$ atomic % together with 10 ppm or more of a Group IIIA impurity in order to ensure the dark resistance of more than $10^{13}\Omega\cdot$ cm. The impurity should be no more than 20000 ppm because the incorporation of a further amount will result in a sudden decrease of the dark resistance. Although an photosensitivity decreases with the increase of the amount of oxygen, the high photosensitivity is maintained as the amount is very small and maximum of only 0.05 atomic %. Especially, the photosensitivity in wavelengths of 400 to 700 nm is quite much higher than Se or PVK-TNF (molar ratio of 1:1).

The reason why the dark resistance of a-Si is significantly increased by the incorporation of oxygen or nitrogen is still unclear in many points, but is presumably that dangling bonds are effectively eliminated by such incorporation. For reasons that $SiH_4$, $Si_2H_6$ or the like is used as the starting material for a-Si production, that hydrogen is used as the carrier gas in the glow discharge decomposition method and further that, when boron is to be included, $B_2H_6$ is used, a-Si generally contains hydrogen in the order of 10–40 atomic percent. With hydrogen alone, however, dangling bonds can be cancelled only to an unsatisfactory extent and the dark resistance increased only to a slight extent. On the contrary, the incorporation of oxygen or nitrogen cancels most of dangling bonds and increases the dark resistance to $10^{13}$ ohm·cm or more. Since a-Si inherently has a wide band gap and a great charge carrier mobility, the layer acts as a charge-transporting layer in an efficient manner. The oxygen may be replaced by an equivalent amount of nitrogen or carbon. As far as a dark resistance of the order $10^{13}$ ohm·cm is attained in the a-Si photoconductive layer 3, any additive may be used.

Figure 2:
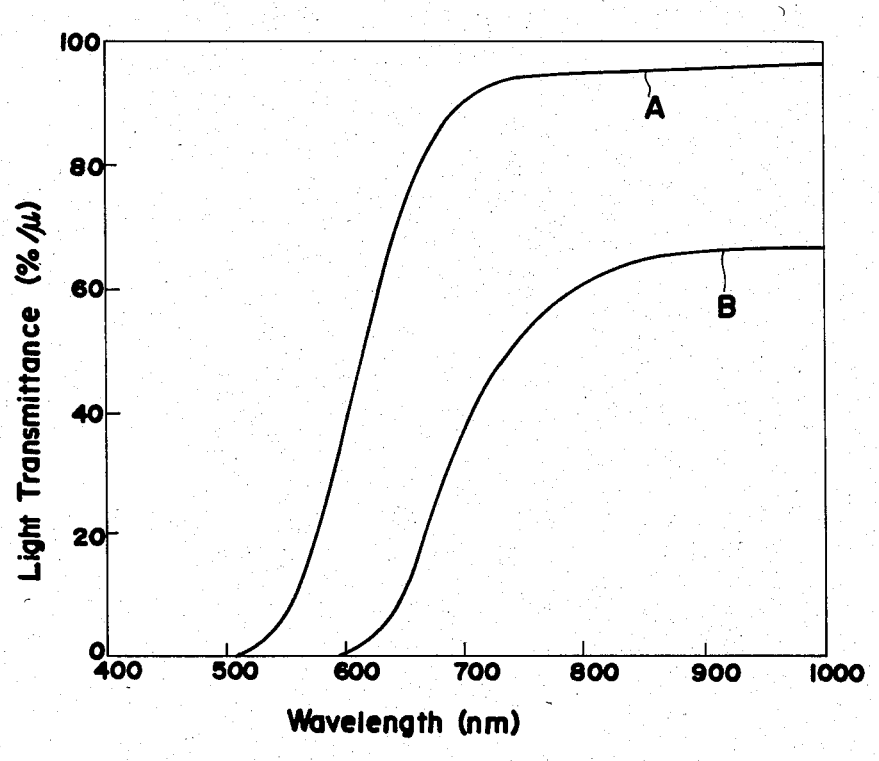
FIG. 2 shows the light transmittance curves for the amorphous silicon and amorphous silicon-germanium photoconductive layers.

As described above, the a-Si photoconductive layer 3 should have a thickness of about 5 to 30 microns, preferably 10 to 20 microns, as this range of thickness is necessary for it to serve as the charge-retaining layer. But also, the reason why the a-Si photoconductive layer should have a thickness of less than 30 microns, preferably 20 microns, is to enable sufficient light absorption by the a-Si:Ge photoconductive layer 2 formed therebelow. Explaining this in detail, FIG. 2 shows for an a-Si photoconductive layer (hydrogen content about 25 atomic percent, oxygen content about 0.01 atomic percent, boron content 40 ppm) and an a-$Si_{0.75}$ $Ge_{0.25}$ photoconductive layer (hydrogen content about 25 atomic percent, oxygen content about 0.01 atomic percent, boron content 40 ppm), the light transmittance per micron of the thickness of each layer (%/micron) as a function of the wavelength varying from 400 to 1000 nm. As can be seen from the figure, the curve A for the a-Si photoconductive layer indicates low light transmittance values at wavelengths of not more than 700 nm, especially in the vicinity of 600 nm but transmittance values as high as 90% or more against light of longer wavelengths than 700 nm. In other words, the a-Si photoconductive layer 3 absorbs a large portion of light in the visible light region to which the layer itself is highly sensitive, while it allows transmission of a large portion of light in the longer wavelength region to which it is less sensitive. Accordingly a large portion of light of 700 nm and longer wavelengths reaches the underlying a-Si:Ge layer 2 which is highly sensitive to light of 700 nm and longer wavelengths. On the other hand, the a-Si:Ge layer 2, as shown by the curve B, is low in light transmittance, or high in light absorptivity, on the longer wavelength side as compared with a-Si and accordingly ensures a high photosensitivity in this region. And in view of the light transmittance, the photosensitivity cannot be ensured due to insufficient absorption of long wave light by the a-Si:Ge photoconductive layer 2 if the thickness of the a-Si photoconductive layer 3 is more than 30 microns. For this reason, the a-Si photoconductive layer 3 should have the thickness of less than 30 microns, preferably less than 20 microns in order to ensure the high photosensitivity.

The photosensitive member described above may further be formed with an a-Si protective layer on the a-Si photoconductive layer 3. Such protective layer contains oxygen or carbon of up to 50 atomic % and non-photoconductive with a thickness of about 0.1 to 3 micron. Formation of this layer is effective to ensure higher initial surface potential. Additionally, a rectifying or a barrier layer may be formed between the substrate 1 and the a-Si:Ge photoconductive layer 2.

Figure 3:
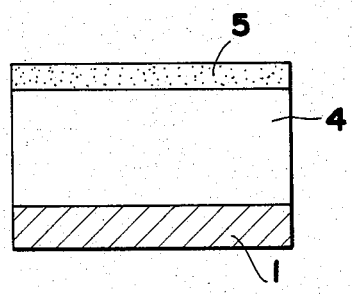
FIG. 3 shows the laminated construction of the photosensitive member according to a second embodiment of the present invention.

Referring now to FIG. 3, which shows a second embodiment of the photosensitive member in accordance with the present invention, 4 is an a-Si semiconductor layer formed on the electrically-conductive layer 1 and 5 is an a-Si:Ge photoconductive layer formed on the a-Si semiconductor layer 4.

The a-Si semiconductor layer 4 is formed on the substrate 1 to a thickness of about 5 to 100 microns, preferably 10 to 60 microns by glow discharge decomposition or sputtering, for instance. This a-Si semicondutor layer 4 primarily functions as a charge-retaining layer, but also functions as a photoconductive layer which ensures the photosensitivity in the visible light region to a certain extent when the thickness of the a-Si:Ge photoconductive layer 5 described hereinbelow is less than 1 micron, particularly less than 0.5 micron. When the a-Si semiconductor layer 4 holds the function of a photoconductive layer as well, it contains as similarly with the a-Si photoconductive layer 3 described above about 10 to 40 atomic % of hydrogen, about $10^{-5}$ to $5\times10^{-2}$ atomic % of oxygen and about 10 to 20000 ppm of a Group IIIA impurity of the Periodic Table. Of course, the oxygen may be replaced by an equivalent amount of nitrogen or carbon.

If the a-Si semiconductor layer 4 is required to function only as a charge-retaining layer, then a further amount of oxygen, nitrogen or carbon may be incorporated.

The a-Si:Ge photoconductive layer 5 is formed on the a-Si semiconductor layer 4 into a thickness of about 0.1 to 2 microns by glow discharge decomposition or sputtering and contains therein at least 10 to 40 atomic % of hydrogen and 10 to 20000 ppm of a Group IIIA impurity of the Periodic Table and preferably also a trace amount of oxygen. Inclusion of a Group IIIA impurity and preferably oxygen in addition to hydrogen is for improving the dark resistance of the layer. In other words, the dark resistance of the a-Si:Ge photoconductive layer 5 with hydrogen alone is too low to cause surface charges to flow transversely, which will result in image disturbance. Incorporation of the above amount of a Group IIIA impurity, preferably boron, improves the dark resistance to a certain order and is effective to eliminate the above-mentioned drawback.

In corporation of oxygen in the amount of $10^{-3}$ to $5\times10^{-2}$ atomic % in addition to hydrogen and boron remarkably increases the dark resistance of the a-Si:Ge photoconductive layer 5 and ensures the prevention of transverse charge flow as well as the increase of charging potential. The oxygen content should be less than $5\times10^{-2}$ atomic % since the amount exceeding impairs the photosensitivity and should be more than $10^{-3}$ atomic % to improve the dark resistance.

This a-Si:Ge photoconductive layer 5 as similarly with the a-Si:Ge photoconductive layer 2 of the first embodiment ensures the photosensitivity in the near infrared region, especially in the longer wavelength region of 700 to 900 nm. The molar ratio of a-Si:a-Ge should similarly be 1:1 to 19:1 for the substantially same reasons. Particularly, when the Ge content is more than 1:1, the sensitivity will rather be decreased due to trapping of charge carriers generated in the a-Si:Ge photoconductive layer 5 in the interface with the a-Si semiconductor layer 4. Moreover, if the a-Si:Ge photoconductive layer 5 is used to ensure the photosensitivity from the visible light region to the near infrared region, the increase of the Ge content will decrease the overall photosensitivity and it is thus required to limit maximum molar ratio to be 1:1.

The thickness of the a-Si:Ge photoconductive layer 5 is about 0.1 to 2 microns as described above, however, the layer thickness should be less than 1 micron, preferably about 0.1 to 0.5 microns if the a-Si semiconductive layer 4 is used also as the photoconductive layer which ensures the photosensitivity in the visible light region to a certain extent. Explaining this in detail by referring to the Curve B in FIG. 2 which shows for an a-$Si_{0.75}Ge_{0.25}$ photoconductive layer (hydrogen content of about 25 atomic %, oxygen content of about 0.01 atomic %, boron content of 40 ppm) the light transmittance per micron of the thickness of the layer (%/micron) as a function of the wavelength varying from 400 to 1000 nm, it is seen that said a-Si:Ge photoconductive layer completely absorbs the light of short wavelengths of up to about 600 nm per micron of the thickness. This means that when the thickness of the a-Si:Ge photoconductive layer 5 is more than 1 micron, no short wave light of less than 600 nm will reach the a-Si semiconductor layer 4 indicating that the photosensitivity below its wavelength will be ensured by the a-Si:Ge photoconductive layer 5 alone. The light transmittance rises at about 600 nm and about 40% at 700 nm, about 60% at 800 nm and about 70% at 900 nm. Accordingly, the a-Si:Ge photoconductive layer 5 has high light absorption in the short wavelengths and low in the longer wavelengths. However, the light absorption is sufficient in the longer wavelengths thus ensuring the photosensitivity extending from the visible light region to the near infrared region. Since the light transmittance discussed above is for 1 micron thickness, the a-Si:Ge photoconductive layer if so formed to have a thickness of less than 1 micron will transmit the short wave light of 600 nm or less therethrough to assign the a-Si semiconductor layer the role to ensure the photosensitivity in the visible light region. Such effect becomes particularly notable when its thickness is made less than 0.5 microns. Otherwise the thickness of the a-Si:Ge photoconductive layer 5 is about 0.1 to 2 microns because a thickness smaller than 0.1 miron cannot ensure the photosensitivity in the longer wavelength region due to insufficient light absorption while a thickness greater than 2 microns decreases the photosensitivity due to trapping of charge carriers in the boundry with the a-Si semiconductor layer 4.

As similarly with the first embodiment, a protective layer may be formed on the a-Si:Ge photoconductive layer 5 and also a rectifying or a barrier layer between the substrate 1 and the a-Si semiconductor layer 4.

In the following, an inductive coupling type glow discharge decomposition apparatus for the production of a photosensitive members in accordance with the invention is described.

Figure 4:
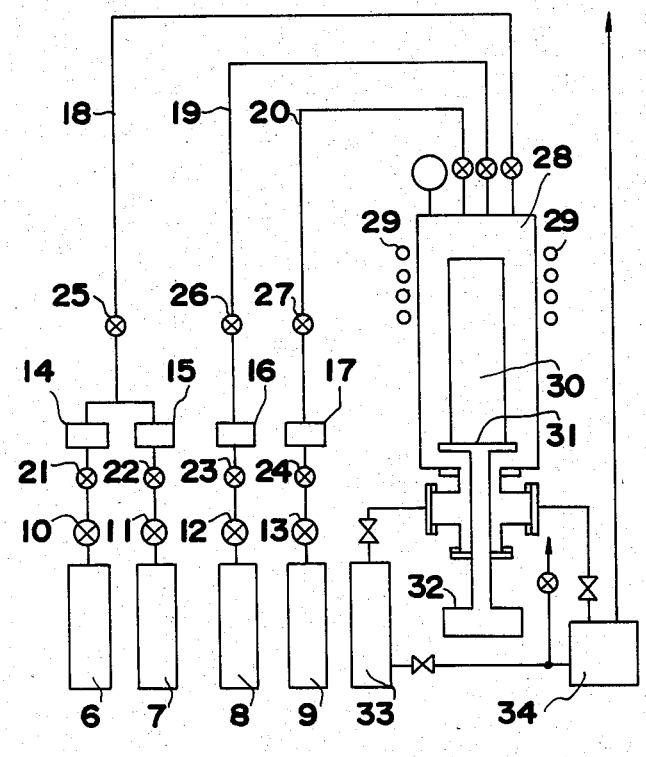
FIGS. 4 and 5 each illustrates a glow discharge decomposition apparatus for producing the photosensitive members according to the present invention.

In FIG. 4, a first, second, third, and fourth tanks 6, 7, 8, and 9 contain $SiH_4$, $B_2H_6$, $GeH_4$, and $O_2$ gases respectively, in the leak-free state. For all the $SiH_4$, $B_2H_6$ and $GeH_4$ gases, the carrier is hydrogen. Ar or He may also be used in place of hydrogen. The above-mentioned gases are released by opening the corresponding first, second, third and fourth regulating valves 10, 11, 12 and 13 at the flow rates controlled by respective mass flow controllers 14, 15, 16 and 17. The gases from the first and second tanks 6 and 7 are led to a first main pipe 18, the $GeH_4$ gas from the third tank 8 is led to a second main pipe 19, and the $O_2$ gas from the fourth tank are led to a third main pipe 20, respectively. The numerals 21, 22, 23 and 24 indicate flowmeters and the numerals 25, 26 and 27 indicate check valves. The gases flowing through the first, second and third main pipes 18, 19 and 20 are fed to a tubular reactor 28 which has a resonance oscillation coil 29 wound thereon. The high frequency power of the coil as such is preferably about 0.1 to 3 kilowatts and the frequency thereof is suitably 1 to 50 MHz. Inside the tubular reactor 28, there is mounted a turntable 31 rotatable by means of a motor 32, and a substrate 30 of aluminum, stainless steel, NESA glass or the like on which an a-Si:Ge photoconductive layer 2 or an a-Si semiconductor layer 4 is to be formed is disposed on said turntable 31. The substrate 30 is uniformly preheated by a suitable heating means to a temperature of about 100° to 400° C., preferably about 150° to 300° C. Because a high degree of vacuum (discharge pressure: 0.5 to 2 torr) is essential within the tubular reactor 28 at the time of layer formation, the reactor is connected with a rotary pump 33 and a diffusion pump 34.

To produce first an a-Si:Ge photoconductive layer 2 of FIG. 1 on the substrate using the glow discharge decomposition apparatus described above, the first and third regulating valve 10 and 12 are opened to release $SiH_4$ and $GeH_4$ gases from the first and third tanks 6 and 8. When boron is to be incorporated, the second regulating valve 11 is also opened to release $B_2H_6$ gas from the second tank 7. Furthermore, when oxygen is to be incorporated, the fourth regulating valve 13 is opened to release $O_2$ gas. The amounts of gases released are controlled by mass flow controllers 14, 15, 16 and 17 and the $SiH_4$ gas or a mixture of $SiH_4$ gas and $B_2H_6$ gas is fed through the first main pipe 18 into the tubular reactor 28. At the same time, $GeH_4$ gas is fed through the second main pipe 19 and also oxygen gas, in a predetermined mole ratio to $SiH_4$, is fed through the third main pipe 20 into the reactor 28. In case of forming the photosensitive member shown in FIG. 3, $SiH_4$, $B_2H_6$ and $O_2$ gases are respectively fed through pipes 18, 19 and 20 in the reactor 28. A vacuum of about 0.5 to 2.0 torr is maintained in the tubular reactor 28, the substrate is maintained at 100° to 400° C., and the high frequency power of the resonance oscillation coil 29 is set at 0.1 to 3 kilowatts with the frequency at 1 to 50 MHz. Under the above conditions, a glow discharge takes place to decompose the gases, whereby an a-Si:Ge photoconductive layer 2 containing hydrogen and optionally oxygen and/or boron or an a-Si semiconductor layer 4 containing hydrogen, boron and oxygen is formed on the substrate 30 at the speed of about 0.5 to 5 microns per 60 minutes.

When the predetermined thickness of the a-Si:Ge photoconductive layer 2 or the a-Si semiconductor layer 4 is formed, the glow discharge is once discontinued. Then, $SiH_4$, $B_2H_6$ and $O_2$ gases from the first, second and fourth tanks 6, 7 and 9 or further $GeH_4$ gas from the third tank 8 are released. Thus, in the same manner, an a-Si photoconductive layer 3 or an a-Si:Ge photoconductive layer 5 is formed respectively on the a-Si:Ge photoconductive layer 2 and the a-Si semiconductor layer 4.

Figure 5:
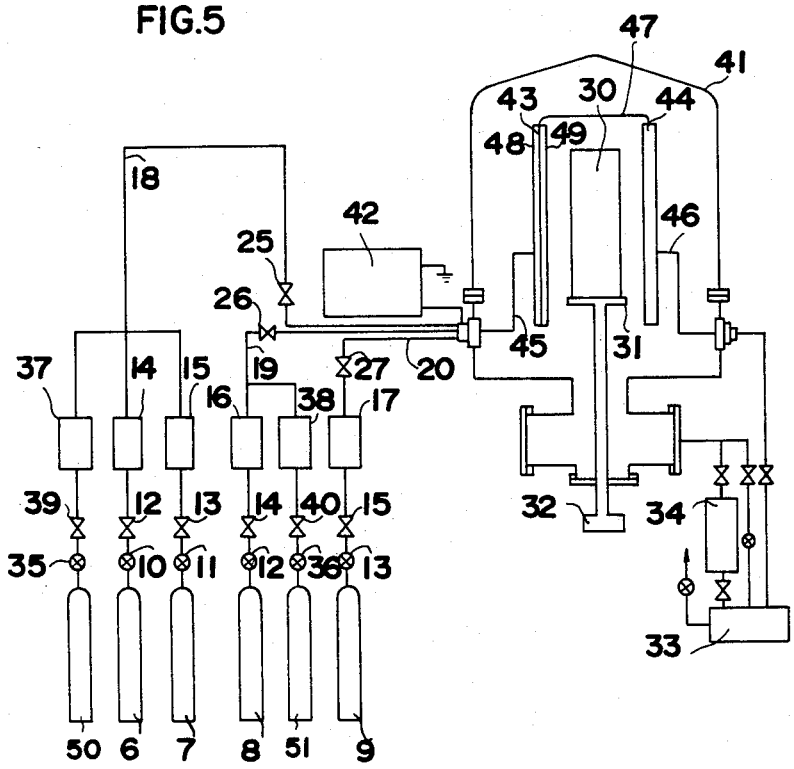

The photosensitive members in accordance with the present invention can also be produced by using a capacitive coupling type glow discharge decomposition apparatus as shown in FIG. 5. The same reference numerals as those in FIG. 4 respectively indicate the same constituents and accordingly mention thereof is omitted. Referring to FIG. 5, the numerals 50 and 51 respectively indicate a fifth and sixth tanks containing hydrogen which is to serve as the carrier gas for $SiH_4$ and $GeH_4$ gases, respectively, 35 and 36 indicate a fifth and sixth regulating valves, 37 and 38 indicate mass flow controllers, and 39 and 40 indicate flowmeters. Inside the reaction chamber 41, there are disposed in parallel with each other a first and second plate electrodes 43 and 44 in close vicinity to a substrate 30. The electrodes 43 and 44 are connected with a high frequency power source 42 on one hand and on the other with a fourth and fifth main pipes 45 and 46, respectively. The first and second plate electrodes are electrically connected with each other by means of a conductor 47.

The above-mentioned first plate electrode 43 comprises two (first and second) rectangular parallelepiped-shaped conductors 48 and 49 superposed with each other. The front wall facing to the substrate 30 has a number of gas-discharging holes, the intermediate wall at the junction has a small number of gas-discharging holes, and the back wall has a gas inlet hole which is to be connected with the fourth main pipe 45. The gaseous material from the fourth main pipe 45 is once stored within the first conductor 48, then gradually discharged through the holes on the intermediate wall and finally discharged through the gas-discharging holes on the second conductor 49. Simultaneously with the gas discharge, a glow discharge is caused by applying an electric power of about 0.05 to 1.5 kilowatts (frequency: 1 to 50 MHz) from the high frequency power source 42 to the first and second plate electrodes 43 and 44, whereby a layer is formed on the substrate 30. On that occasion, the substrate 30 is maintained in an electrically grounded state or a direct-current bias voltage is applied to the substrate itself. This apparatus has the advantages that the electric discharge of the plate electrodes is uniform, that the layer formation and distribution is uniform, that the gas decomposition efficiency is good and the speed of film-formation is rapid, and further that the gas introduction is easy and the construction is simple.

The following experimental examples are further illustrative of this invention.

EXPERIMENTAL EXAMPLE 1

A photosensitive member according to FIG. 1 of the present invention was produced using a glow discharge decomposition apparatus as shown in FIG. 4. A pyrex glass tube, 100 mm in diameter and 600 mm in height, was used as the tubular reactor 28 with a resonance oscillation coil 29 (130 mm in diameter, 90 mm in height, 10 turns) wound around the reactor.

An aluminum drum, 80 mm in diameter, was used as the substrate 30. The drum was placed on the turntable 31 and heated to about 200° C. The tubular reactor 28 was evacuated to $10^{-6}$ torr by means of the rotary pump 33 and diffusion pump 34. Thereafter, the rotary pump alone was driven continuously. Then, $SiH_4$ gas was released from the first tank 6 using hydrogen as the carrier gas (10% $SiH_4$ relative to hydrogen), at the flow rate of 70 sccm and $GeH_4$ gas (10% $GeH_4$ relative to hydrogen) from the third tank 8 at the flow rate of 14 sccm. Under application of a high frequency power of 160 watts (frequency : 4 MHz) to the coil 29, an a-$Si_{0.75}$ $Ge_{0.25}$ photoconductive layer was formed at the speed of 1 1 micron/60 minute. The discharge pressure was 1 torr.

When the a-$Si_{0.75}$ $Ge_{0.25}$ photoconductive layer containing about 25 atomic % of hydrogen and having a thickness of about 0.5 micron is formed, the glow discharge is temporarily stopped and thereafter, $SiH_4$ gas was released from the first tank 6 at the flow rate of 70 sccm, $B_2H_6$ gas (80 ppm in hydrogen) from the second tank 7 at 18 sccm and $O_2$ gas from the fourth tank 9 at 0.3 sccm. Under the same condition as above, the glow discharges was effected to form the a-Si photoconductive layer on the a-$Si_{0.75}$ $Ge_{0.25}$ photoconductive layer which has a thickness of 15 microns and containing about 25 atomic % of hydrogen, 40 ppm of boron and 0.01 atomic % of oxygen. The thus-obtained photosensitive member is referred to as Sample A.

A photosensitive member having the same construction but containing 40 ppm of boron in addition to hydrogen in the a-$Si_{0.75}$ $Ge_{0.25}$ photoconductive layer and a photosensitive member containing 40 ppm of boron and 0.01 atomic % of oxygen together with hydrogen in the a-$Si_{0.75}$ $Ge_{0.25}$ photoconductive layer were produced under the same conditions. These two members are referred to as Sample B and Sample C respectively.

Each photosensitive member was charged to +300 V and tested for the spectral sensitivity by determining the light energy required for the surface potential to be reduced by half in relation with the wavelength of the light emitted for irradiation of the photosensitive member, which wavelength was successively varied at 50-nm intervals in the range of 500–850 nm, using a monochromator.

Figure 6:
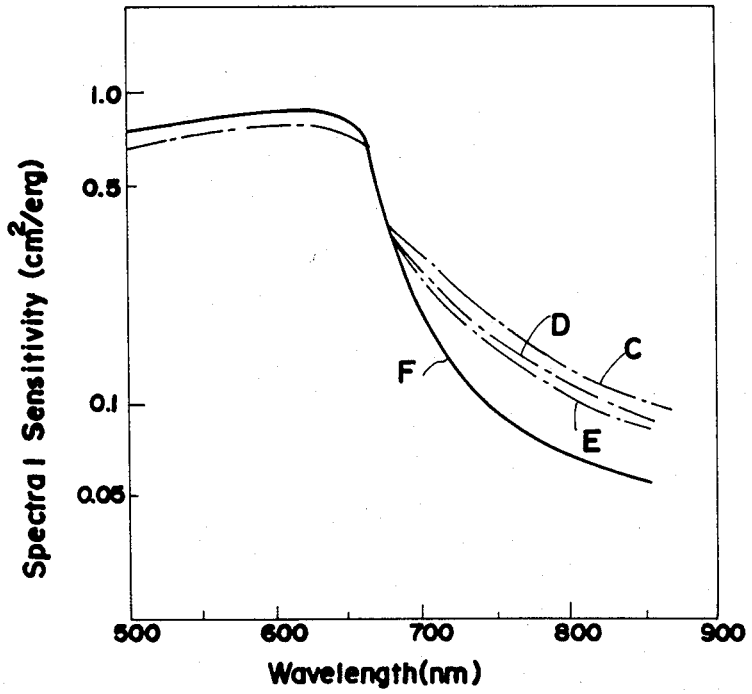
FIGS. 6 and 7 each shows the spectral sensitivity of the photosensitive member according to the present invention.

The results are shown in FIG. 6, wherein Curves C, D and E correspond to Samples A, B and C, respectively. Curve F illustrates the spectral sensitivity of a photosensitive member having only an a-Si photoconductive layer on the substrate. As is clear from the figure, the photosensitive member according to the present invention is markedly improved in the photosensitivity in the longer wavelength region. When compared with the photosensitive member having only the a-Si photoconductive layer and illustrated by Curve F, the Sample A with the a-$Si_{0.75}$:$Ge_{0.25}$ photoconductive layer containing hydrogen only is most sensitive in the longer wavelength region and in particular, the sensitivity at wavelength of 700 nm is 0.22 $cm^2$/erg for the former and 0.32 $cm^2$/erg for the latter, while the sensitivity at 750 nm is 0.12 for the former and 0.23 for the latter and the sensitivity at 800 nm is 0.07 for the former and 0.14 for the latter and further 0.06 for the former and 0.11 for the latter at 850 nm, indicating about 1.5 times and about 2 times increased photosensitivity levels in the latter. For Sample B (Curve D) containing boron in the a-$Si_{0.75}$ $Ge_{0.25}$ photoconductive layer and for Sample C (Curve E) containing oxygen also, the sensitivities are somewhat lower than Sample A but sufficiently higher than Curve F. Moreover, each photosensitive member ensures high sensitivity in the visible light region which the a-Si photoconductive layer inherently has. For example, high sensitivity of 0.8 $cm^2$/erg at 600 nm and 0.81 $cm^2$/erg at 650 nm is ensured.

Photosensitive members having the same constitution as Sample B except that the a-$Si_{0.75}$ $Ge_{0.25}$ photoconductive layer contained 200, 2000 and 20000 ppm of boron together with hydrogen were produced and tested for the spectral sensitivity. Measurements revealed successively decreased sensitivity levels in the longer wavelength region with the increase in the boron content as compared with Curve D. Nevertheless, each sample member was more sensitive than the sample illustrated by Curve F.

Furthermore, photosensitive members each having the same constituent as Sample A except that the thickness of a-Si photoconductive layer was 5, 20, 30 and 35 microns, respectively were produced and tested for the spectral sensitivity. The results showed the tendency for the sensitivity in the longer wavelength region to decrease with the increase of the thickness of the a-Si photoconductive and conversely increases with the decrease of the thickness indicating the dependance on the light transmittance described in connection with FIG. 2. For the photosensitive member with the a-Si photoconductive layer of 5 micron thick, the sensitivity is 0.25 $cm^2$/erg at 750 nm and 0.19 at 800 nm which is quite much higher than curve C. On the contrary, the sensitivities of photosensitive members each with 20, 30 and 35 micron thick a-Si photoconductive layer are lower than curve C and particularly the one with 35 micron thick a-Si photoconductive layer has lower sensitivity than curve F. Accordingly, it is necessary that the thickness of the a-Si photoconductive layer to be less than 30 micron, preferably less than 20 microns.

At last, photosensitive members each having the same constitution as Sample A except that the Si:Ge molar ratio in the a-Si:Ge photoconductive layer was 19:1, 10:1, 2:1 and 1:1, respectively, were produced and tested for the spectral photosensitivity. Even the Ge content as small as 19:1 improved the sensitivity on the longer wavelength side and the sensitivity increased as the Ge content increased. Thus, the photosensitive member containing Ge in the ratio 2:1 is about 1.3–1.7 times more sensitive as compared with Curve C. However, the photosensitive member in which the Si:Ge molar ratio is 1:1 is less sensitive than that in which said ratio is 2:1. The cause and reason are not clear in some respects but presumably that, when a large amount of Ge is incorporated, carriers generated in the a-Si:Ge photoconductive layer are trapped in the interface with the a-Si photoconductive layer due to the considerably narrow band gap of Ge as compared with that of a-Si. In this context, the ratio 1:1 is the uppermost limit for the Si-Ge ratio.

In an image forming experiment, the photosensitive member sample A was used in a laser beam printer. The photosensitive member was charged positively with a corona discharger and exposed to a directly modulated semiconductor laser beam (generator wavelength 780 nm, 3 mW) using a rotating polyhedral mirror to form a negative image thereon, followed by reversal development with a positively charged toner using a magnetic brush, transfer, cleaning and erasion. The photosensitive member was driven at the speed of 130 mm/sec. In this manner, 15 A4-sized sheets of paper were printed per minute. Very clear and distinct 10 dots/mm characters were reproduced. The print quality was such that the images were clear and distinct even after printing of 100,000 sheets.

EXAMPLE 2

Using the same glow discharge decomposition apparatus as the one used in Example 1 and shown in FIG. 4, a photosensitive member according to FIG. 3 of the present invention was produced.

Having preheated an aluminum drum of 80 mm in diameter to a temperature of about 200° C. and vacuumizing the tubular reactor to the discharge pressure of 1 torr, the $SiH_4$ gas was released from the first tank 6 using hydrogen as the carrier gas (10% $SiH_4$ relative to hydrogen at the flow rate of 70 sccm, $B_2H_6$ gas (80 ppm in hydrogen) from the second tank 7 at the rate of 18 sccm and $O_2$ gas from the fourth tank 8 at the rate of 0.3 sccm. Under application of a high frequency power of 160 watts (frequency:4 MHz) to the coil, an a-Si semiconductor layer 4 of 20 micron thick and containing about 25 atomic % of hydrogen, 0.01 atomic % of oxygen and 40 ppm of boron was formed at the speed of 1 micron/60 minute.

Followed thereby, the $SiH_4$ gas and $B_2H_6$ gas of the same flow rates as above and also $GdH_4$ gas (10% in hydrogen) at the flow rate of 14 sccm were released from the first, second and fourth tank 6, 7 and 9 and under the same condition as above, an a-$Si_{0.75}$ $Ge_{0.25}$ photoconductive layer 5 of 0.1 micron thick and containing about 25 atomic % of hydrogen and 40 ppm of boron was formed on the a-Si semiconductor layer. The thus-obtained photosensitive member is referred to as Sample D.

Under the same condition as above, a photosensitive member of the same construction but further containing about 0.01 atomic % of oxygen in the a-$Si_{0.75}$ $Ge_{0.25}$ photoconductive layer was produced as Sample E and also a photosensitive member of the same construction as Sample E but forming the a-$Si_{0.75}$ $Ge_{0.25}$ photoconductive layer in a thickness of 2 micron was produced as Sample F.

Each photosensitive member was charged to +400 V and tested for the spectral sensitivity by determining the light energy required for the surface potential to be reduced by half in relation with the wavelength of the light emitted for irradiation of the photosensitive member, which wavelength was successively varied at 50-nm intervals in the range of 500–850 nm, using a monochromator.

Figure 7:
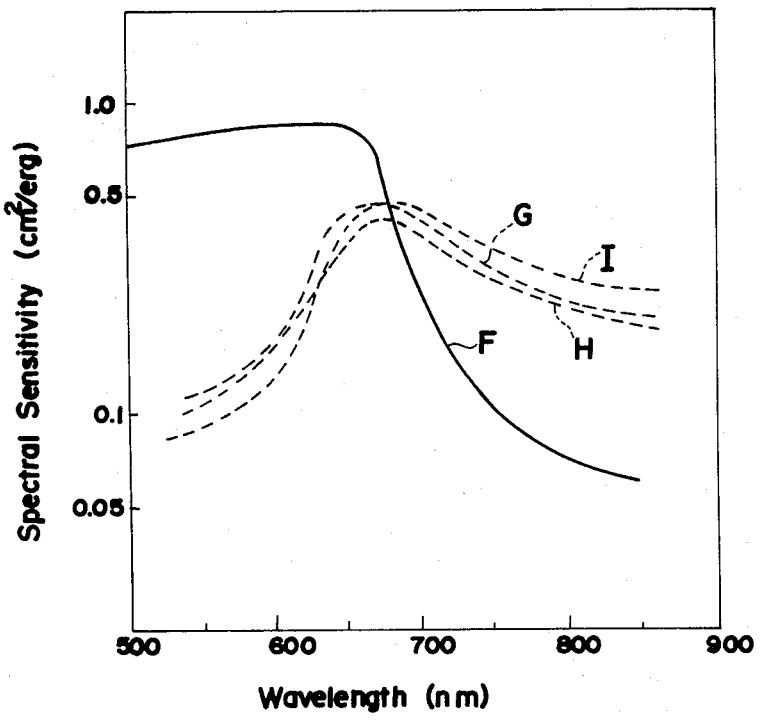

The results are shown in FIG. 7, wherein Curves G, H and I correspond to Samples D, E and F, respectively. Curve F illustrates the spectral sensitivity of a photosensitive member having only an a-Si photoconductive layer on the substrate. As is clear from the figure, the photosensitive member according to the present invention is markedly improved in the photosensitivity in the longer wavelength region of 700 nm or more. When compared with the photosensitive member having only the a-Si photoconductive layer and illustrated by Curve F, the Sample F (Curve I) with the a-$Si_{0.75}$ $Ge_{0.25}$ photoconductive layer containing hydrogen, boron and oxygen and having a thickness of 2 micron is most sensitive in the longer wavelength region and in particular, the sensitivity at wavelength of 700 nm is 0.22 $cm^2$/erg for the former and 0.46 $cm^2$/erg for the latter, while the sensitivity at 750 nm is 0.12 for the former and 0.36 for the latter and the sensitivity at 800 nm is 0.07 for the former and 0.28 for the latter and further 0.06 for the former and 0.25 for the latter at 850 nm, indicating about 2 to 4 times increased photosensitivity levels in the latter. For Sample D containing only hydrogen and boron in the a-$Si_{0.75}$ $Ge_{0.25}$ photoconductive layer of 0.1 micron thick, the sensitivity in the longer wavelength region is somewhat lower than Sample F as shown by Curve G but sufficiently higher than Curve F. Sample E similarly exhibits high sensitivity in the longer wavelength region as shown by Curve H and the reason why its sensitivity is lower than Sample F is because the thickness of the a-$Si_{0.75}$ $Ge_{0.25}$ photoconductive layer is thinner.

In the visible light region, each of the photosensitive member has lower sensitivity as compared with Curve F but sufficiently sensitive as there is the sensitivity of more than 0.1 $cm^2$/erg at 600 nm for each. For Samples D and E, the sensitivities in the visible light region are higher than Sample F as their a-Si semiconductor layers function as photoconductive layers. On the other hand, Sample F with the large thickness of the a-Si:Ge photoconductive layer has a lowest sensitivity and it is for this reason that its thickness be no thicker than 2 microns.

A photosensitive member of the same construction as Sample E but containing about 0.05 atomic % of oxygen in addition to hydrogen and boron in the a-$Si_{0.75}$ $Ge_{0.25}$ photoconductive layer was prepared. The spectral sensitivity measured revealed lower sensitivities than Curve H both in the visible light region and in the near infrared region but sufficiently higher than Curve F. However, it is believed that further incorporation of oxygen will lower the sensitivity to become similar to Curve F and for this reason, the oxygen content should be no more than 0.05 atomic % at maximum.

Photosensitive members having the same constitution as Sample E except that the a-$Si_{0.75}$ $Ge_{0.25}$ photoconductive layer contained 200, 2000 and 20000 ppm of boron together with hydrogen and oxygen were produced and tested for the spectral sensitivity. Measurements revealed successively decreased sensitivity levels in the longer wavelength region with the increase in the boron content as compared with Curve H. Nevertheless, each sample member was more sensitive than the sample illustrated by Curve F.

At last, photosensitive members each having the same constitution as Sample E except that the a-Si:Ge molar ratio in the a-Si:Ge photoconductive layer was 19:1, 10:1, 2:1 and 1:1, respectively, were produced and tested for the spectral photosensitivity. Even the Ge content as small as 19:1 improved the sensitivity on the longer wavelength side and the sensitivity increased as the Ge content increased. Thus, the photosensitive member containing Ge in the ratio 2:1 is about 1.4–1.9 times more sensitive as compared with Curve H. However, the photosensitive member in which the Si:Ge molar ratio is 1:1 is less sensitive than that in which said ratio is 2:1. The cause and reason are not clear in some respects but presumably that, when a large amount of Ge is incorporated, carriers generated in the a-Si:Ge photoconductive layer are trapped in the interface with the a-Si semiconductor layer due to the considerably narrow band gap of Ge as compared with that of a-Si. In this context, the ratio 1:1 is the uppermost limit for the Si-Ge ratio.

In an image-forming experiment, the photosensitive member Sample E was used in the laser beam printer discussed in Example 1. Very clear and distinct images were reproduced even after printing of 100,000 sheets.

Numerous modifications and variations of the present invention are possible in the light of the above teachings and, therefore, within the scope of the appended claims, the invention may be practiced otherwise than as particularly described.

What is claimed is:

1. A photosensitive member which comprises an electrically-conductive substrate, an amorphous silicon-germanium photoconductive layer overlying said electrically-conductive substrate, said amorphous silicon-germanium photoconductive layer having a thickness of about 0.1 to 3 microns and a molar ratio of silicon to germanium of about 1:1 to 19:1, and an amorphous silicon photoconductive layer overlying said amorphous silicon-germanium photoconductive layer, said amorphous silicon photoconductive layer having a thickness of about 5 to 30 microns.

2. A photosensitive member as claimed in claim 1 wherein said amorphous silicon-germanium photoconductive layer includes about 10 to 40 atomic of hydrogen and 10 to 20000 ppm of a Group IIIA impurity of the Periodic Table.

3. A photosensitive member as claimed in claim 2 wherein said amorphous silicon photoconductive layer includes about 10 to 40 atomic % of hydrogen, 10 to 20000 ppm of a Group IIIA impurity of the Periodic Table and $10^{-5}$ to $5\times10^{-2}$ atomic % of oxygen.

4. A photosensitive member as claimed in claim 3 wherein the thickness of said amorphous silicon photoconductive layer is about 10 to 20 microns.

5. A photosensitive member which comprises an electrically-conductive substrate, an amorphous silicon semiconductor layer having a thickness of about 5 to 100 microns, and an amorphous silicon-germanium photoconductive layer formed on said amorphous silicon semiconductor layer and having a thickness of about 0.1 to 2 microns an a molar ratio of silicon to germanium of about 1:1 to 19:1 and further containing about 10 to 40 atomic % of hydrogen, 10 to 20000 ppm of a Group IIIA impurity of the Periodic Table and $10^{-3}$ to $5\times10^{-2}$ atomic % of oxygen.

6. A photosensitive member which comprises an electrically-conductive substrate, an amorphous silicon photoconductive layer having a thickness of about 5 to 100 micron and containing about 10 to 40 atomic % of hydrogen, 10 to 20000 ppm of a Group IIIA impurity of the Periodic Table and $10^{-5}$ to $5\times10^{-2}$ atomic % of oxygen, and an amorphous silicon-germanium photoconductive layer formed on said amorphous silicon photoconductive layer and having a thickness of less 1 micron and more than 0.1 micron and containing about 10 to 40 atomic % of hydrogen, 10 to 20000 ppm of a Group IIIA impurity of the Periodic Table and $10^{-3}$ to $5\times10^{-2}$ atomic % of oxygen.

7. A photosensitive member as claimed in claim 6 wherein the thickness of said amorphous silicon-germanium photoconductive layer is preferably about 0.1 to 0.5 microns.

* * * * *